US008104177B2

(12) United States Patent
Plumb et al.

(10) Patent No.: US 8,104,177 B2
(45) Date of Patent: Jan. 31, 2012

(54) HAMMER MILL HAMMER

(75) Inventors: Chad J. Plumb, Harlan, IA (US); Todd K. Plumb, Harlan, IA (US); Ron R. Ronfeldt, Harlan, IA (US); Christine D. Petersen, Harlan, IA (US); Robert H. Knox, Harlan, IA (US)

(73) Assignee: Jacobs Corporation, Harlan, IA (US)

( * ) Notice: Subject to any disclaimer, the term of this patent is extended or adjusted under 35 U.S.C. 154(b) by 791 days.

(21) Appl. No.: 12/147,117

(22) Filed: Jun. 26, 2008

(65) Prior Publication Data

US 2009/0321546 A1 Dec. 31, 2009

(51) Int. Cl.
*B21D 53/10* (2006.01)

(52) U.S. Cl. ..... 29/898.07; 241/194; 241/195

(58) Field of Classification Search ..... 29/898.06, 29/898.061, 898.066, 898.04, 898.054, 898.07, 29/898.09; 241/191–195, 189.1
See application file for complete search history.

(56) References Cited

U.S. PATENT DOCUMENTS

| | | | | |
|---|---|---|---|---|
| 2,272,118 | A | 2/1942 | Imse | |
| 2,404,775 | A | 7/1946 | Ehmann | |
| 2,462,138 | A | 2/1949 | Spangenberg | |
| 2,647,695 | A | 8/1953 | Rogers | |
| 2,728,975 | A | 1/1956 | Potter | |
| 2,763,439 | A | 9/1956 | Mankoff | |
| 2,952,901 | A | 9/1960 | King | |
| 3,186,651 | A | 6/1965 | Briolini | |
| 3,482,789 | A | 12/1969 | Newell | |
| 3,738,586 | A * | 6/1973 | Fabert, Jr. | 241/195 |
| 3,818,746 | A | 6/1974 | Fujita | |
| 4,337,559 | A | 7/1982 | Rangel | |
| 4,907,750 | A | 3/1990 | Seifert | |
| 5,443,216 | A | 8/1995 | Lajoie | |
| 6,419,173 | B2 | 7/2002 | Balvanz | |
| 7,140,569 | B2 | 11/2006 | Young | |
| 7,419,109 | B1 * | 9/2008 | Ronfeldt et al. | 241/189.1 |

FOREIGN PATENT DOCUMENTS

| | | |
|---|---|---|
| EP | 0015693 | 9/1980 |

* cited by examiner

*Primary Examiner* — David Bryant
*Assistant Examiner* — Ryan J Walters
(74) *Attorney, Agent, or Firm* — Sturm & Fix LLP

(57) ABSTRACT

A method of avoiding hammer rod-hole deformation in a hammer mill. Conventional hammers are fitted with a bearing structure that reduces wear while permitting the hammer to pivot about multiple axes. An optional, integral spacer provides spacing between adjacent hammers.

10 Claims, 9 Drawing Sheets

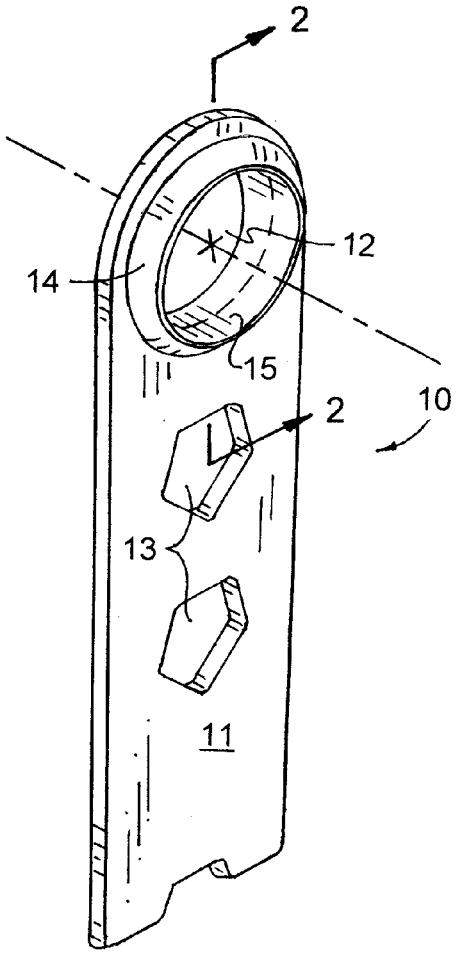
Fig. 1
Fig. 2
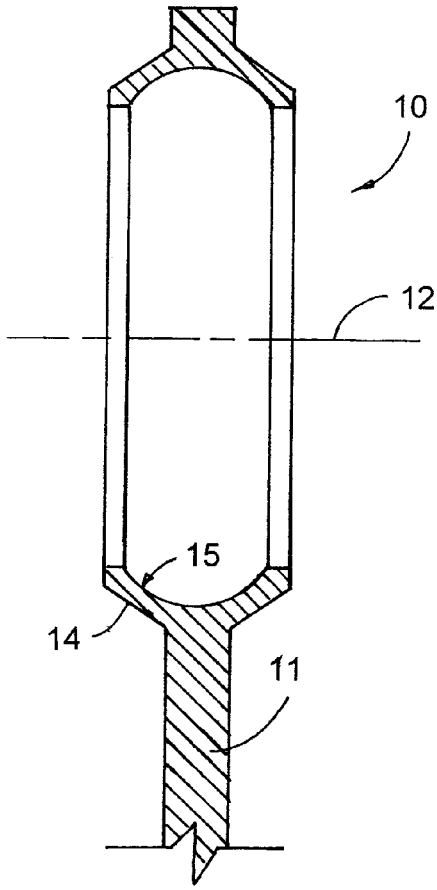

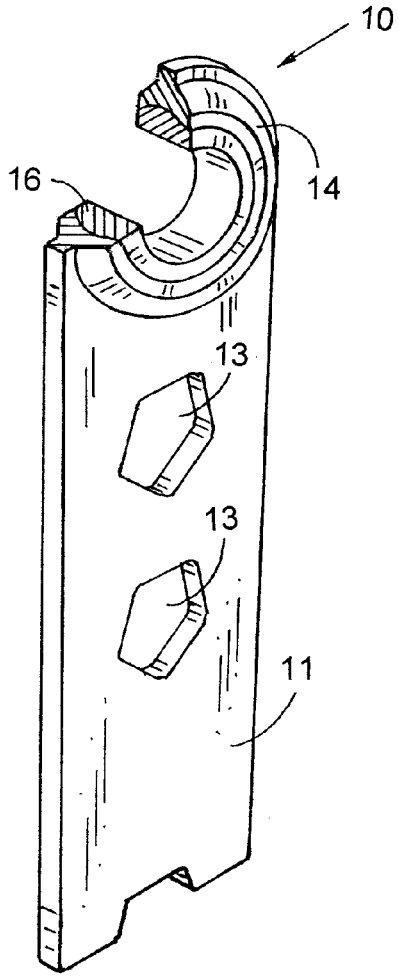
Fig. 4
Fig. 5
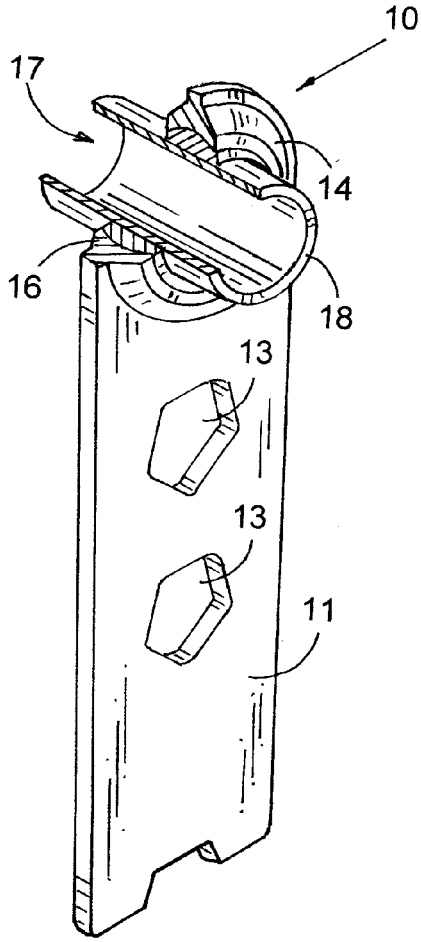

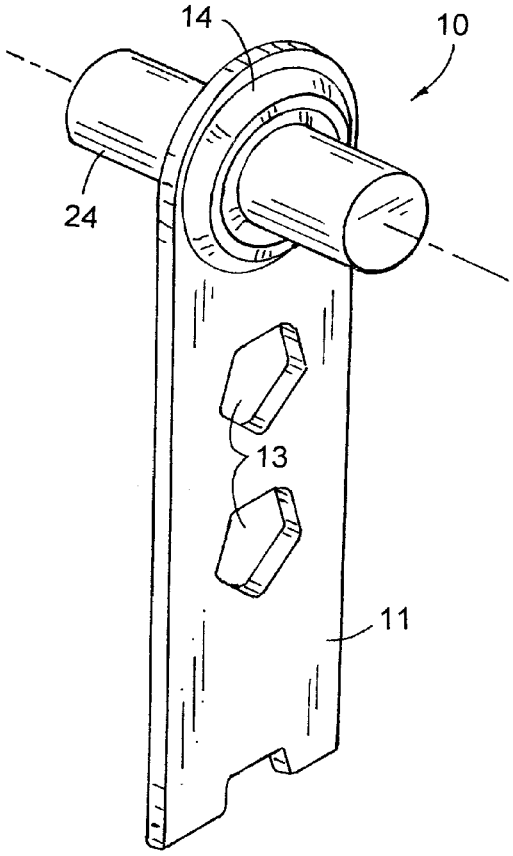
Fig. 6
Fig. 7
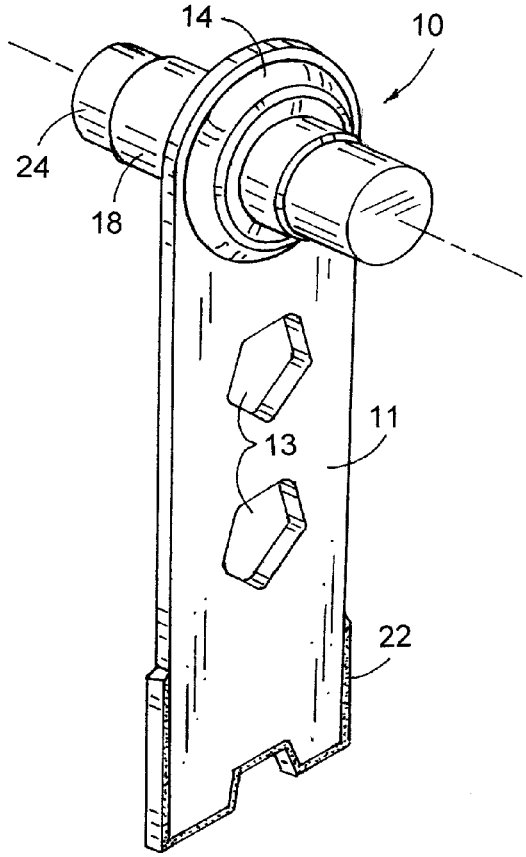

*Fig. 13*
Prior Art
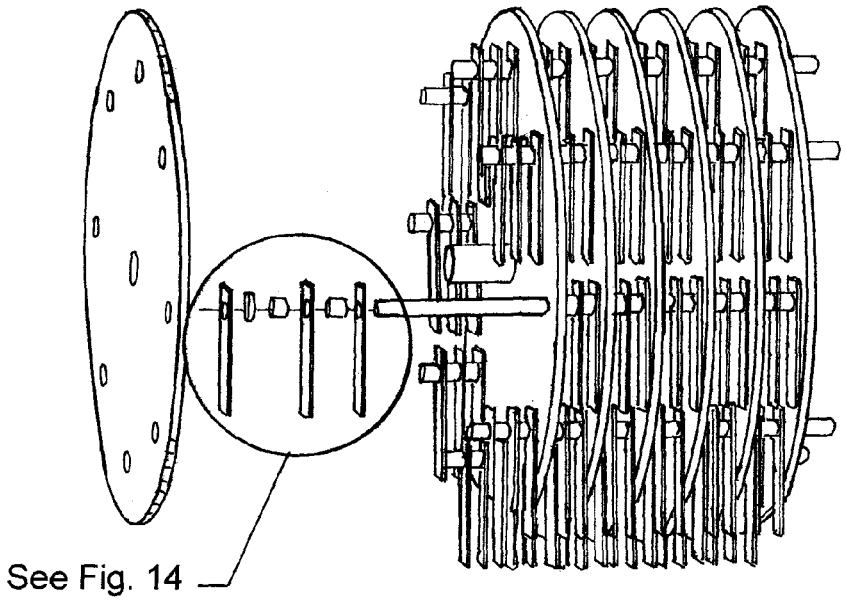
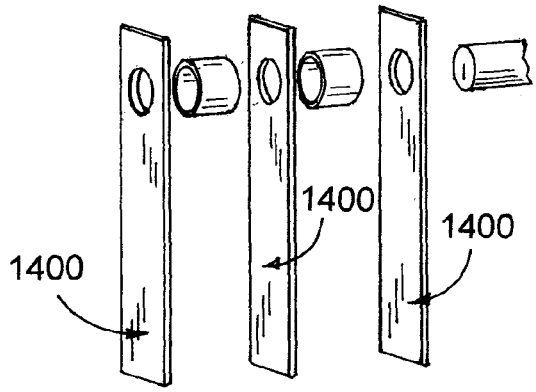
*Fig. 14*
Prior Art

HAMMER MILL HAMMER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to hammer mills. More particularly, this invention relates to an improved two or three piece hammer that reduces hole elongation and side loading of the hammer.

Hammer mills have long been used for grinding or comminution of materials. A typical hammer mill comprises a rotor mounted on a rotor shaft inside a housing. A rotor 1100 according to the prior art is illustrated at rest in FIG. 11 and in motion in FIG. 12. A material inlet is generally located at the top of the housing with one or more material outlets located near the bottom of the housing. The rotor 1100 includes a drive shaft and rows of hammers 1400, normally comprising flat steel blades or bars, as illustrated in FIGS. 13 and 14. The hammer 1400 is pivotally connected to the rotor 1100 via a steel rod or pin. The rotor 1100 is mounted inside a typically teardrop shaped enclosure, known by those skilled in this art as a grinding or working chamber. In a reversible hammer mill, this grinding chamber comprises a cutting plate mounted on either side of the material inlet. Reversible hammer mills are capable of rotation in either direction, a feature providing increased life for the hammers 1400, cutting plates, and screen plates. Present-day cutting plates comprise an upper, linear section connected with a convex section, and do not allow particles to escape. Downstream of the cutting plate, the interior of the working chamber is defined by curved screen plates. The screen opening diameter is selected to match the desired final particle size. Particles less than or equal to the desired size exit the chamber through the screens while material greater than the desired size are further reduced by the rotating hammers 1400.

Numerous industries rely on hammer mill grinders or impact grinders to reduce material to a smaller size. For example, hammer mills are often used to process forestry products, agricultural products, minerals, and materials for recycling. Specific examples of materials processed by hammer mills include grains, animal food, pet food, feed ingredients, mulch, wood, hay, plastics, and dried distiller grains. Hammer mills heretofore have long been employed to effect size reduction in such diverse materials as scrap metal, paper, animal and human feed, or anything else that needs to be reduced in size.

Standard hammers, when grinding a product in a hammer mill, impact the product to be pulverized to create a smaller average size particle. This impact forces material against a perforated screen area that also cuts and sizes the product. Inside the typical hammer mill, numerous forces act. A force exists toward the tip of the hammer, where the hammer impacts the material to be comminuted. Also present inside the mill is a axial force, parallel to the rotor shaft, on a side of the hammer due to the material entering the mill. The combination of these two co-existing forces cause elongation to the pivot hole in the hammer, decreased life, and the eventual failure of the hammer. Accordingly there is a need for a hammer mill design to compensate for impact loading, side loading, wear, and hole elongation. There are also tub grinders and impact crushers that use the hammer setup.

Manufacturing methods utilizing forgings, rolling, and casting are well known in the art to improve the life and functionality of the hammer.

The two pieces are preferably forged together in a similar manufacturing process as that disclosed in U.S. Pat. No. 2,728,975, hereby incorporated in its entirety by reference.

Treatment Methods such as welding weld material to the end of the hammer blade are well known in the art to improve the grinding functionality and life of the hammer. These methods typically infuse the hammer edge, through welding, with a metallic material resistant to abrasion or wear such as tungsten carbide. See, for example, U.S. Pat. No. 6,419,173, incorporated herein by reference, describing methods of attaining hardened hammer tips or edges, as are well known by those skilled in the art.

Increasing the hammer strength with the addition of edge weld and increasing the hardness of the hammer material decreases the fatigue strength of the hammer when subjected to dynamic loading. In the prior art, the roundness of the rod hole deteriorates, leading to elongation of the hammer rod hole. Elongation of the hammer rod hole continues until the material yields and yielding in operation causes failure/fracture of the hammer at the rod. The fracture is catastrophic and causes mechanical failure in the mill, damage to the housing, screens and other hammers, as well as safety concerns to workers near mills. Design changes including making the hammer wider at the rod, such as disclosed in U.S. Pat. No. 7,140,569 which is hereby incorporated by reference, have been attempted but still experience field failure due to the side loading of the hammer.

BRIEF SUMMARY OF THE INVENTION

Rod-hole deformation is overcome by providing a two- or, optionally, three-piece design. It is therefore an object of the present invention to provide an end bearing structure comprising a race with an integrated spacer, and a hammer blade with an integrated bearing surface. An additional object is to provide an optional third piece comprising a separate liner installed between the bearing and race surfaces in order to mitigate elongation of the hammer blade pivot hole immediately adjacent to the pivot rod, the liner can also serve as a coating to reduce the friction and wear between the race and the blade to increase service life in elevated dynamic loading situations. A further object is to improve the ease and safety of installation and maintenance of hammer blades within a hammer mill. Still another object is to eliminate unnecessary spacers between the hammer blades when installed onto the pivot rods.

Effecting the above objects results in a stronger bearing structure designed to deflect and lessen the dynamic side loading on the hammer blade when in motion and under load. Reduction in wear on the leading, bottom, and trailing edges of the hammer by infusing an unyielding material ultimately increase the life cycle of the hammer blade and reduces costs associated with replacement and maintenance of the hammer mill.

In a hammer mill, including a housing defining a hammer mill grinding chamber with at least one inlet and one outlet, a rotor is disposed centrally in the housing for rotation about a rotor axis of rotation. A screen is disposed at a predetermined radial location relative to the rotor's axis of rotation. Operatively, pivotally attached to the rotor is a plurality of hammers grouped in sets and disposed periodically about the rotor's axis of rotation. All hammers within a single set have a common axis of rotation lying parallel to the rotor's axis of rotation. The hammers' axes of rotation are disposed at a common radial distance relative to the rotor's axis of rotation. At least one of the hammers in each group has an opening in one end corresponding to the common hammer axis of rotation.

The present invention may be manufactured using methods of forging, casting or rolling, as are well known by those having skill in the art.

The hammers require no new installation procedures or equipment. The present invention eliminates the need to utilize spacers. This is accomplished through a variable length race with an integrated spacer. The width of the race with the integrated spacer may range from one quarter to ten inches. This design feature reduces installation time and improves the overall safety to the personnel assembling or maintaining the hammer mill due to the lessening of the need to align hammers, spacers and rods during installation. The installation is also safer for users as with a typical setup, rods must be forced through holes using impact devices while the operator manually holds the spacers. Utilizing the incorporated spacers the operators' hands are clear from pinch points within the mill.

Established forging techniques, well known in the art of fitting two-piece bearing like structures together, are used in the manufacture of the two-piece end bearing structure disclosed herein.

The inner race, with the integrated spacer, augments the two-piece end bearing structure by maintaining a predetermined distance between one or more hammer blades when installed on the pivot rod within the hammer mill. The inner race also improves the two-piece end bearing structure by assisting in the dispersal of anticipated dynamic forces that ultimately affect the hammer blade assembly and the hammer mill pivot rod. This additional feature reduces fatigue, and stress and enhances resistance to deformation and inordinate wear acquired through use. The life of the hammer blade assembly is, therefore, extended.

Installation of hammers with races integrated with the spacer is also made easier and quicker, whether the installation is initial or replacement. It is also predicted to improve the safety of this procedure in the field by reducing the number of parts and alignment issues associated with existing hammer blades and hammer mills.

BRIEF DESCRIPTION OF THE SEVERAL VIEWS OF THE DRAWINGS

FIG. 1 is a perspective view of a hammer mill hammer blade with an integrated, internal bearing surface;

FIG. 2 is a cross sectional view of the hammer mill hammer blade with an integrated, internal bearing surface;

FIG. 4*b* is a cross sectional view of the individual race without the integrated spacer;

FIG. 4 is a perspective cross sectional view of a sub-assembly comprising the hammer mill hammer blade with the integrated, internal bearing surface, and the inner race without the integrated spacer;

FIG. 5 is a perspective cross sectional view of the sub-assembly comprising the hammer mill hammer blade with the integrated, internal bearing surface and the inner race with an integrated spacer;

FIG. 6 is a perspective view of the hammer mill hammer blade assembly on a shaft without the integral spacer;

FIG. 7 is a perspective view of the hammer mill hammer blade assembly on the shaft with the integral spacer and additional material added to the lower leading, trailing, and bottom sides;

FIG. 13 is a perspective view of an exploded view of a hammer mill rotor of the prior art; and FIG. 14 is a detail view of a partial exploded view of a hammer mill rotor of the prior art.

DETAILED DESCRIPTION OF THE INVENTION

Figure 3A:
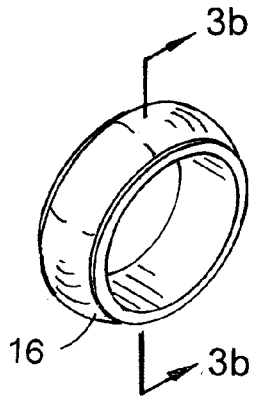
FIG. 3*a* is a perspective view of an individual race without an integrated spacer.
Figure 3B:
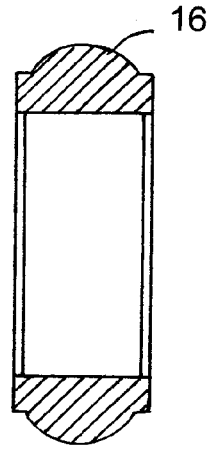
FIG. 3*c* is a perspective view of the individual race with the integrated spacer.
FIG. 3*d* is a cross detail of the individual race with the integrated spacer.

Referring now to the drawings, wherein like reference numerals designate identical or corresponding parts throughout the several views, FIG. 1 shows a hammer mill hammer blade assembly 10, comprising a hammer blade body 11, and an integrated outer bearing race 14, the outer bearing race comprising an inner surface or cup 15. The cutaway view of FIG. 2 provides an additional angle showing that the outer bearing race 14 is integrated with the hammer blade body 11. Voids 13, in the hammer blade body 11, are optional to reduce the weight of the hammer blade assembly 10 and/or to enhance the milling process by increasing the dynamic movement of particles from rod to screen in the mill and providing additional impact surfaces. The voids can be round, rectangular, pentagonal, or multiple of shapes and achieve the same function.

FIGS. 3*a* and *b* illustrate an inner bearing race 16, which in use, is disposed within and concentric to the outer bearing race 14, as shown in FIG. 4. The cup 15 conforms to the shape of the outer surface of the inner bearing race 16.

Figure 3C:
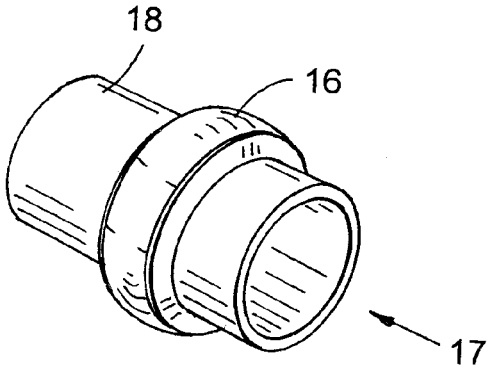
Figure 3D:
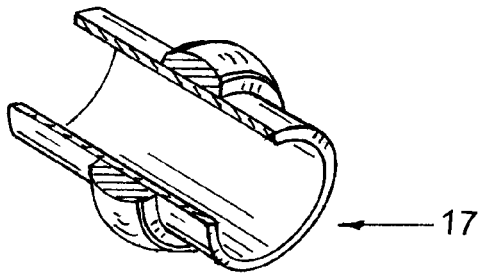

FIGS. 3*c* and *d* illustrate an inner bearing race assembly 17, comprising the inner bearing race 16 and a spacer 18. In the preferred embodiment, these two parts: the inner bearing race 16 and the spacer 18, are integral. That is, they are made from the same mass of material to form the inner bearing race assembly 17.

Figure 8:
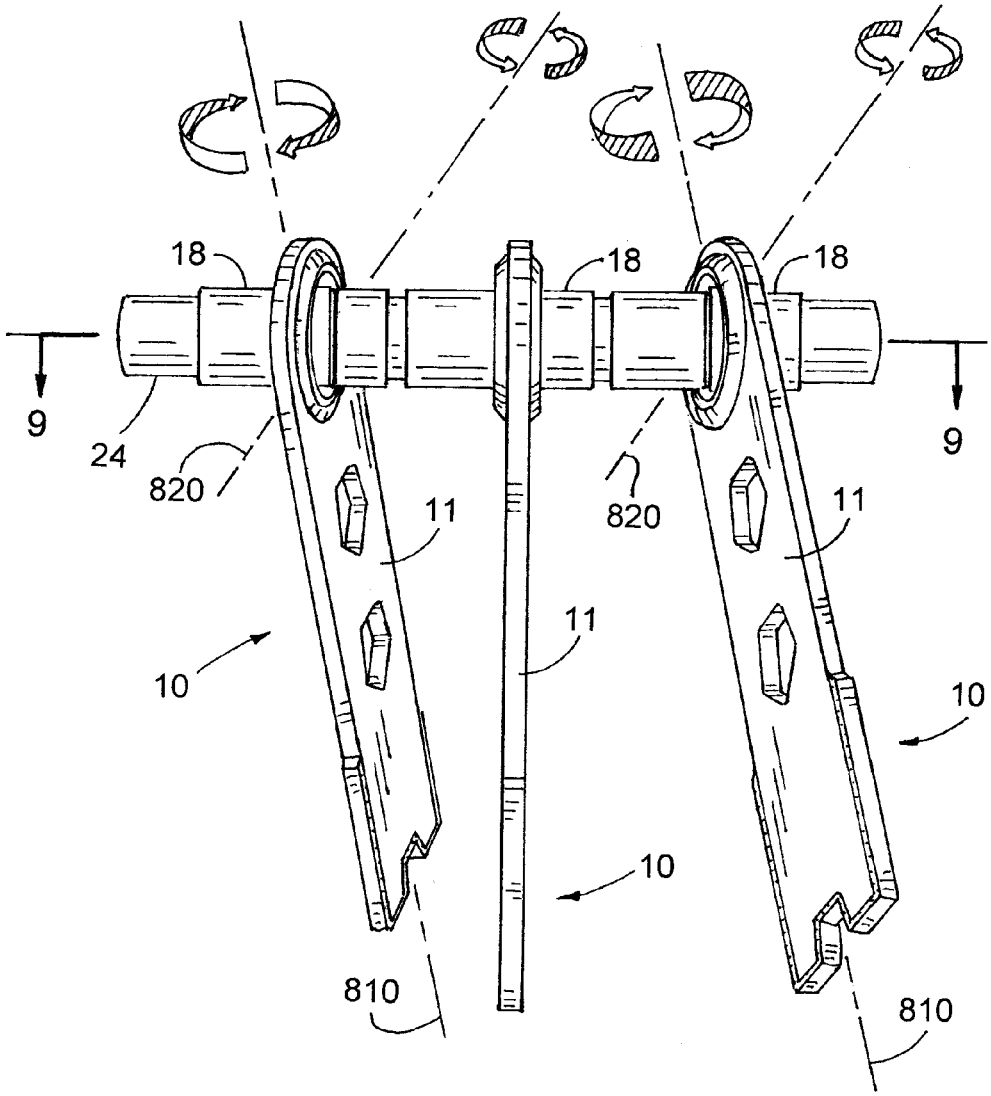
FIG. 8 is a side elevation view illustrating the rotational capabilities of the hammer mill hammer blade assembly when installed onto a sub-assembly rod.
Figure 9:
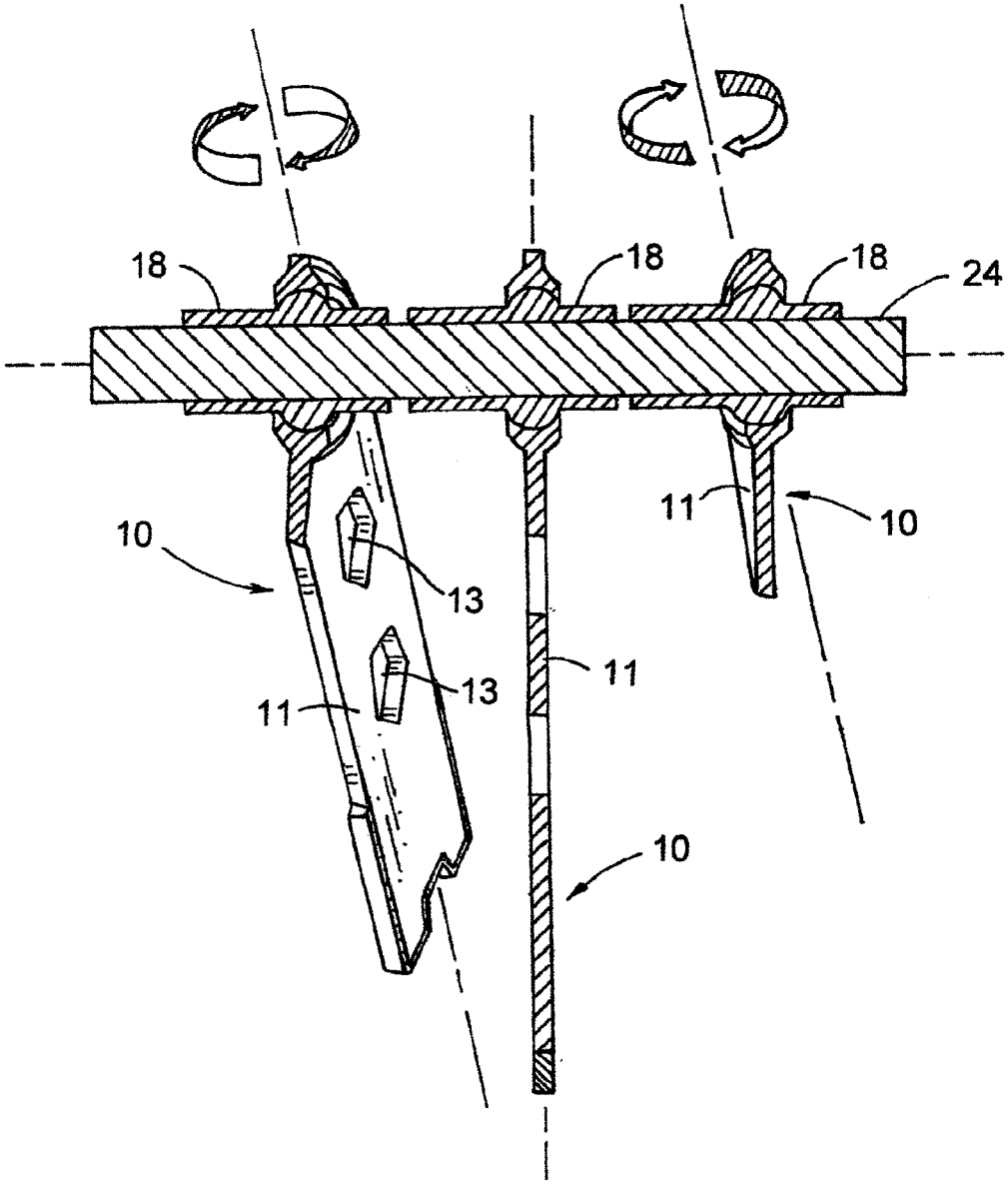
FIG. 9 is a cross-sectional view of the hammer mill hammer blade assembly of FIG. 8.
Figure 11:
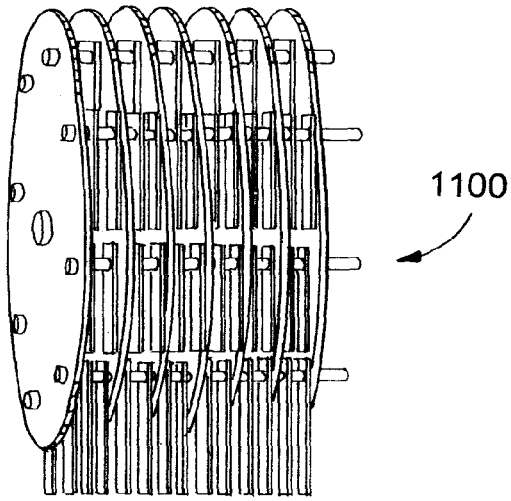
Fig. 11 Prior Art
FIG. 11 is a perspective view of an assembled hammer mill rotor of the prior art at rest.
Figure 12:
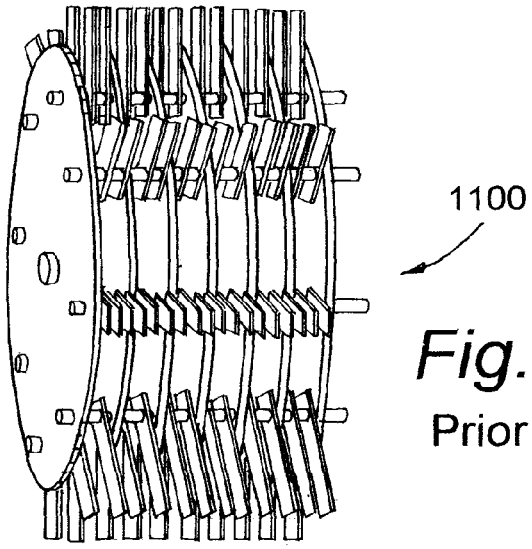
Fig. 12 Prior Art
FIG. 12 is a perspective view of an assembled hammer mill rotor of the prior art in motion.

The outer surface of the inner bearing race 16, with or without the integral spacer 18, is convex to mate with the concave inner surface 15 of the outer bearing race 14 as illustrated in FIGS. 4 and 5, where the optional integral spacer 18 is included in FIG. 5 but not in FIG. 4. The concavity of the outer bearing race 14 is a result of a manufacturing process, as described below. The choice of curvature of the convex and concave surfaces is well understood by those versed in the present art, to permit the hammer blade body 11 to adequately pivot on axes 810, 820 not parallel to the axis of rotation of the rotor 1100 (see FIGS. 10-12), as shown in FIGS. 8 and 9. Such shapes include an elliptical segment and circular arc. Because of the additional degrees of freedom of the hammer mill hammer blade 11 of the present invention, side loading on the hammer assembly 10 is relieved by rotation, and the load is thus transferred to the rod 24 (see FIG. 6) holding the hammer assembly 10 as a linear load.

The inner race 16 without the integral sleeve 18 is shown installed in the hammer mill hammer blade body 11 in FIG. 6. The method used to unite these two parts is described below.

The inner bearing race assembly 17 is shown installed in the hammer mill hammer blade body 11 in FIGS. 6 and 7. In FIG. 6, the optional integral spacer is not included, whereas in FIG. 7, the inner bearing race assembly 17 includes the optional integral spacer. The method used to unite the inner bearing race assembly 17 and the hammer mill hammer blade body 11 is described later. In FIG. 7, additional material 22 has been added to particular wear points, preferably by welding, to increase the life of the hammer mill hammer body 11.

In FIGS. 8 and 9, a set or subset of hammer mill hammer assemblies 10 on a shaft 24. The illustrated hammer assemblies 10 include integral spacers 18 to provide the necessary spacing between the hammer bodies 11. However, separate spacers may also be used with hammer assemblies 10 without integral spacers 18, such as those illustrated in FIGS. 4 and 6.

FIGS. 8 and 9 also illustrate the extra degrees of freedom by which the hammer body 11 may pivot. Axes of rotation 810, 820 are not parallel to the longitudinal axis of the shaft 24 on which the hammer assemblies 10 are mounted. Pivotal motion about these axes of rotation 810, 820 is permitted by sliding the outer bearing race 14 relative to the inner bearing race 16 due to the appropriate curvature of the mating surfaces of these races 14, 16.

The inner race 16 is manufactured utilizing a lathe. The inner race 16 is preferably made of 1030, 1040, 52100 or similar carbon steel, but the present invention is not limited to a particular race material. The inner race 16 is manufactured to needed width when incorporating the integrated spacer 18 design. The arc of the inner race 16 is designed so as to conform to the material malleability characteristics of the hammer blade body 11.

The hammer mill hammer blade 11 is manufactured by forging to required dimensions, coining the hammer blade 11 for tolerances, and drilling the hole 12 to its required tolerance. The hammer blade 11 is forged and machined with a cylindrical hole 12 with excess material around the hole 12 on both sides of the hammer blade 11.

Figure 10:
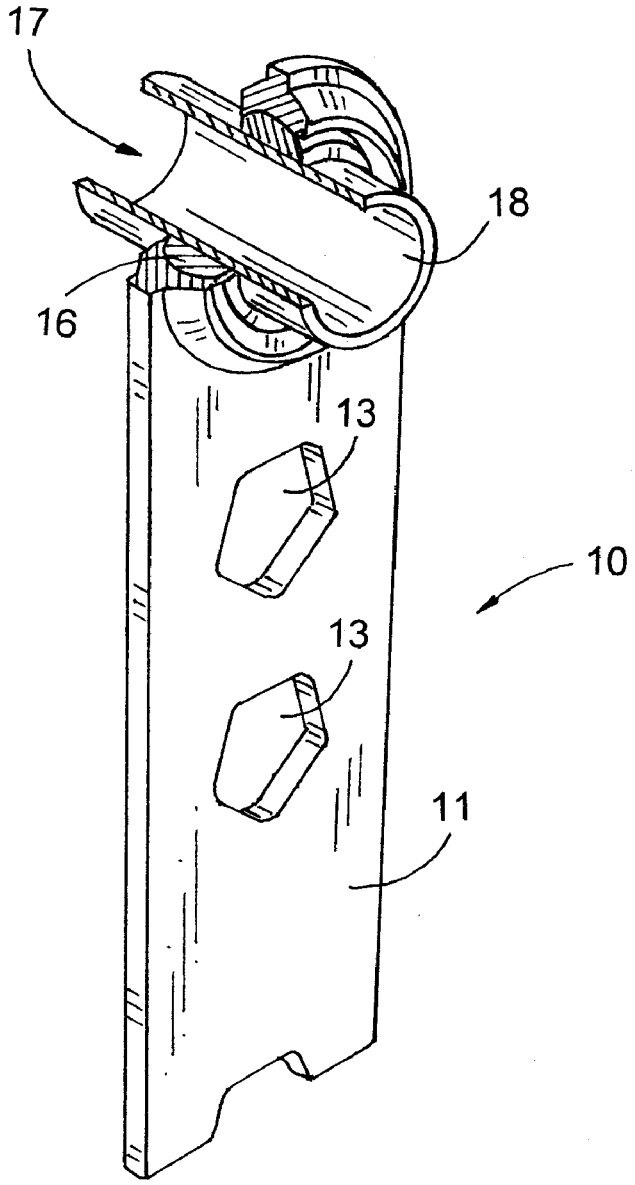
FIG. 10 is a perspective view of the inner race inside an outer race, integral with the hammer mill hammer blade body, prior to forging the parts together.

An initial step in assembling the inner bearing race 16 to the hammer blade 11 is to heat the hammer blade 11, thus allowing the cooled inner bearing race 16 to be placed inside the hole 12 as depicted in FIG. 10.

The next step in the manufacturing process is to final forge the hammer blade 11 and move excess material around the hole 12 in contact with the inner race 16, thus making the hammer blade 11 form a cup around the outer race 14.

The next step is to heat the hammer blade 11 and utilizing a forging press or drop hammer forging, wherein two dies are pressed together. The dies are manufactured to hold the inner race 16 center and the material of the hammer blade 11 is rolled at 45° to 60° relief to match the curvature of the inner race 16. The end result is that of FIG. 4 or 5, depending on whether or not the hammer assembly 10 includes the integral spacer 18.

The next step is heat treatment and loading of the hammer blade assembly 10. The heat treatment process at designated temperature creates expansion and contraction throughout the forged part. The material deformation stress is relieved and the inner race 16 outside diameter reduces and the hammer blade inside diameter increases. The forged hammer cup 15 loses 10% of the original deformation. At this point, the hammer mill blade body 11 may pivot about the inner race 16 about the pivot axis 820 with approximately 1-2 degrees of movement. In some applications that race will be manufactured with 0 degrees of movement after heat treatment to increase start-up behavior in some mills, the hammer mill blade body 11 will still achieve full pivot when loaded. In other applications, the outside hammer will be manufactured to achieve full rotation after heat treatment for mills with high start-up impact loading.

Full pivot of the hammer mill blade body 11 is achieved when loaded into the hammer mill. A loading, preferably greater than 100 ft·lbs, deforms the material on a 45-60 degree relief until the material of the hammer mill blade body 11 reaches its yield point. At this point, the inner race is fully set, and any side loading of the hammer mill blade body 11 is relieved by rotation, and the load is transposed to a linear load on the rod 24 on which the hammer blade assembly 10 is mounted. This change in directional force, as well as the increase in bearing surface relative to the prior art, reduces the working stress of the hammer blade body 11 well below the yield point so the hammer blade body 11 experiences no inelastic deformation and failure as seen with hammers 1400 in the prior art. Even toward the end of the hammer assembly's life the inner race 16 will be able to rotate approximately 15°.

Although only an exemplary embodiment of the invention has been described in details above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A method of improving a life of a hammer mill hammer blade assembly, the hammer mill hammer blade assembly comprising a hammer blade body, the method comprising:

(a) providing an inner bearing race separate from a rod about which the hammer blade body rotates, wherein the inner bearing race remains stationary with respect to the rod;

(b) providing an outer bearing race stationary with respect to the hammer blade body;

(c) disposing the inner bearing race concentric to the outer bearing race;

(d) disposing a spacer concentric to the inner bearing race;

(e) disposing the inner bearing race over and concentric with the rod about which the hammer blade body rotates; and (f) providing space between the hammer blade body and a second hammer blade body by virtue of the spacer disposed between the first hammer mill hammer bearing and the second hammer mill hammer bearing.

2. The method of claim 1 wherein providing an outer bearing race comprises forming the hammer blade body to comprise the outer bearing race.

3. The method of claim 1 wherein disposing the inner bearing race concentric to the outer bearing race comprises:

(a) forming an inner, cylindrical surface in the hammer blade body;

(b) disposing the inner bearing race within said inner, cylindrical surface; and (c) shaping the hammer blade body to produce the outer bearing race mated with the inner bearing race.

4. The method of claim 3 wherein shaping the hammer blade body comprises forging the hammer blade body.

5. The method of claim 1 wherein disposing a spacer concentric to the inner bearing race comprises forming the spacer integral with the inner bearing race.

6. The method of claim 1 additionally comprising:

(a) shaping an outer surface of the inner bearing race to a predetermined curvature;

(b) shaping an inner surface of the outer bearing race to a predetermined curvature; and (c) permitting the inner bearing race to pivot in the outer bearing race about an axis of pivot not parallel to a longitudinal axis of the rod about which the hammer blade body rotates.

7. The method of claim 1 wherein disposing a spacer concentric to the inner bearing race comprises:

(a) producing a hollow, cylindrical spacer; and (b) disposing said hollow, cylindrical spacer over and concentric with the rod about which the hammer blade body rotates.

8. The method of claim 1 wherein disposing the inner bearing race concentric to the outer bearing race comprises:

(a) forming a hole in the hammer blade body;

(b) heating the hammer blade body;

(c) disposing the inner bearing race inside the hole;

(d) moving excess material around the hole in contact with the inner bearing race;

(e) making the hammer blade body form a cup around the outer bearing race;

(f) heating the hammer blade body;

(g) rolling a material of the hammer blade body utilizing a forging process;

(h) matching a curvature of the outer bearing race to a curvature of the inner bearing race;

(i) heat treating the hammer blade body; and (j) loading the hammer mill hammer blade assembly to increase a pivot angle about an axis not parallel to a longitudinal axis of the rod about which the hammer blade body rotates.

9. The method of claim 1 wherein providing the inner bearing race comprises shaping an outer surface of the inner bearing race as a segment of an ellipse.

10. The method of claim 1 wherein providing the inner bearing race comprises shaping an outer surface of the inner bearing race as a segment of a circular arc.

* * * * *